US009664155B2

(12) United States Patent
Mah et al.

(10) Patent No.: US 9,664,155 B2
(45) Date of Patent: May 30, 2017

(54) AIR INDUCTION SYSTEM HAVING AN ACOUSTIC RESONATOR

(71) Applicant: MANN+HUMMEL GMBH, Ludwigsburg (DE)

(72) Inventors: Keat Boon Mah, Portage, MI (US); Matthias Alex, Heilbronn (DE)

(73) Assignee: MANN+HUMMEL GMBH, Ludwigsburg (DE)

( * ) Notice: Subject to any disclaimer, the term of this patent is extended or adjusted under 35 U.S.C. 154(b) by 61 days.

(21) Appl. No.: 14/558,766

(22) Filed: Dec. 3, 2014

(65) Prior Publication Data

US 2016/0160818 A1 Jun. 9, 2016

(51) Int. Cl.
*F01N 1/02* (2006.01)
*F02M 35/12* (2006.01)

(52) U.S. Cl.
CPC .... *F02M 35/1261* (2013.01); *F02M 35/1255* (2013.01)

(58) Field of Classification Search
CPC ..... F02M 35/1261; F02M 35/1255
USPC ..... 123/184.57; 181/204
See application file for complete search history.

(56) References Cited

U.S. PATENT DOCUMENTS 5,783,780 A * 7/1998 Watanabe ..... F02M 35/1272 181/229
6,758,304 B1 * 7/2004 McLean ..... F02M 35/125 123/184.57
7,117,974 B2 * 10/2006 Moenssen ..... F02M 35/1216 123/184.55
7,757,808 B1 * 7/2010 Vaz ..... F01N 1/02 123/184.57
7,845,466 B2 * 12/2010 Kostun ..... F02B 33/44 123/184.57
7,934,581 B2 * 5/2011 Kim ..... F04D 29/665 123/184.53
2008/0023262 A1 * 1/2008 Hayashi ..... F02M 35/1255 181/229
2015/0107935 A1 * 4/2015 Dobrin ..... F02M 35/1261 181/214

* cited by examiner

*Primary Examiner* — Marguerite McMahon
(74) *Attorney, Agent, or Firm* — James Hasselbeck

(57) ABSTRACT

An air induction system for attenuating sound produced by an engine, a housing defining a working chamber for attenuating sound produced by the engine. The air induction system further includes a tube having a first end extending into the working chamber and a second end to be in fluid communication with the engine. The air induction system further includes a first flange radially extending from the tube and disposed in the working chamber. The tube, the housing and the first flange cooperate to define a resonator operable to attenuate sound produced by the engine.

8 Claims, 3 Drawing Sheets

AIR INDUCTION SYSTEM HAVING AN ACOUSTIC RESONATOR

FIELD

The present disclosure generally relates to an air induction system. More particularly, the present disclosure relates to an acoustic resonator of an air induction system that attenuates sound produced by an engine. In one particular application, the present disclosure relates to an acoustic resonator with a tube having a flange proximate an end thereof.

BACKGROUND

This section provides background information related to the present disclosure which is not necessarily prior art.

Air induction systems are used in motor vehicles and for other applications to transport air from the environment to an engine for combustion. As air moves through the air induction system and into the engine, noise and vibration from the engine may be transmitted and amplified by the passages forming the air induction system. It order to reduce the volume and other characteristics of these noises, it may be desirable to utilize a resonator that vibrates at a frequency equal and opposite to that produced by the engine. In this manner, sound waves may be produced that cancel or reduce the sound waves produced by the engine.

According to one known type of acoustic resonator, a tube in communication with an engine may extend into an air filter box housing. Sound produced by the engine may be attenuated by adjusting a length that the tube extends into the air filter box housing. The sound produced by the engine may also be attenuated by adjusting a neck area of the tube.

Different types of resonators have been used for automotive and related applications. According to one particular type the acoustic resonator includes an inline expansion chamber.

While known resonators have generally proven to be acceptable for their intended purposes, a continued need in the relevant art remains. In this regard, packaging considerations may restrict the application of conventional manners of sound attenuation.

SUMMARY

This section provides a general summary of the disclosure, and is not a comprehensive disclosure of its full scope or all of its features.

According to one particular aspect, the present disclosure provides an air induction system for attenuating sound produced by an engine. The air induction system includes a housing defining a working chamber for attenuating sound produced by the engine, a tube having a first end extending into the working chamber and a second end to be in fluid communication with the engine, and a first flange radially extending from the tube and disposed in the working chamber. The tube, the housing and the first flange cooperate to define a resonator operable to attenuate sound produced by the engine.

According to another particular aspect, the present disclosure provides an air induction system for attenuating sound produced by an engine. The air induction system includes a housing defining a working chamber for attenuating sound produced by the engine. The housing includes an inlet and an outlet. A filter is disposed in the working chamber between the inlet and outlet of the housing. The air induction system additionally includes a tube having a first end extending into the working chamber and a second end to be in fluid communication with the engine. The air induction system further includes a first flange radially extending from the tube and disposed in the working chamber. The tube, the housing and the first flange cooperate to define a resonator operable to attenuate sound produced by the engine.

According to yet another particular aspect, the present disclosure provides an air induction system for attenuating sound produced by an engine. The air induction system includes a conduit for delivering a source of intake air to the engine. A housing defines a working chamber for attenuating sound produced by the engine. A tube has a first end in fluid communication with the conduit such that the source of intake air flows past the first end and a second end extending into the working chamber. A first flange radially extends from the tube and is disposed in the working chamber. The tube, the housing and the first flange cooperate to define a resonator operable to attenuate sound produced by the engine.

According to still yet another particular aspect, the present disclosure provides a method of attenuating sound produced by an engine. The method includes providing a housing defining a working chamber for attenuating sound produced by the engine, a tube having a first end extending into the working chamber and a second end to be in fluid communication with the engine, and a first flange radially extending from the tube and disposed in the working chamber. The method additionally includes attenuating sound produced by the engine with a resonator cooperatively defined by the tube, the housing and the first flange.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
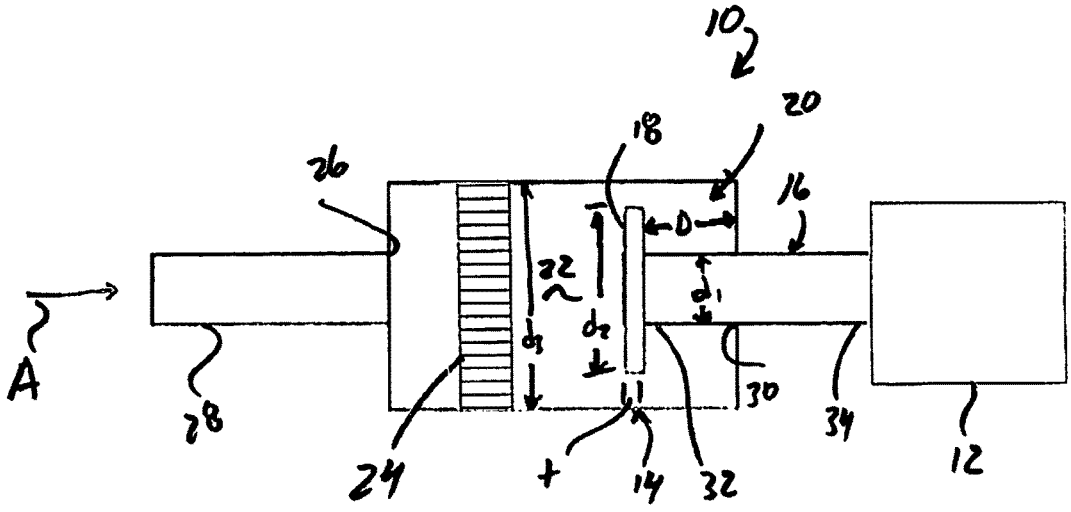
FIG. 1 is a simplified schematic view of an air induction system including a resonator in accordance with the teachings of the present disclosure, the air induction system shown operatively associated with a source of intake air and a vehicle engine.

With initial reference to FIG. 1, a simplified view of an air induction system constructed in accordance with the present teachings is illustrated and identified at reference character 10. The air induction system 10 may be used to transport and filter a source of intake air A from and between the environment and an engine 12 or other device utilizing a flow of air. As will be described in more detail below, the air induction system 10 may also be used to attenuate sound produced by the engine 12. By way of example only, the air induction system 10 may be to cancel out or otherwise tune sound waves produced by the engine 12.

As shown in FIG. 1, the air induction system 10 may generally include a housing 14, a tube 16 providing fluid communication between the housing and the engine 12, and at least a first flange 18 radially extending from the tube 16. As will become more apparent below, the housing 14, the tube 16 and the flange 18 cooperate to define an acoustic resonator 20 for attenuating sound produced by the engine 12. The engine may be an internal combustion engine 12 for a motor vehicle (not shown), for example.

The housing 14 defines a working chamber 22 in which sound produced by the engine 12 is attenuated. As illustrated, the housing may be an air filter box housing 14 and an air filter 24 may be disposed within the working chamber 22. Insofar as the present teachings are concerned, the filter 24 will be understood to be conventional in construction. The filter 24 may filter the intake air A as the intake air A travels through the housing 14 from the environment to the engine 12. It will be understood that the filter 24 may be alternatively disposed in a different housing within the scope of the present teachings.

The housing 14 includes an inlet 26 in fluid communication with the intake air A through a duct 28. The housing 14 further includes an outlet through which the tube 16 extends. The filter 24 is disposed between the inlet 26 and the outlet 30. In such an arrangement, the working chamber 22 of the housing 14 is an inline chamber through which all intake air A delivered to the engine 12 passes.

The tube 16 includes a first end 32 and a second end 34. The first end 32 passes through the outlet 30 of the housing 14 and extends into the working chamber 22. The second end 34 of the tube 16 may be secured in fluid communication with the engine 12 in any manner well known in the art.

The flange 18 is disposed in the working chamber 22 and is secured to the tube 16 proximate the first end 32 thereof. The flange 18 radially extends from the tube 16. As illustrated, the flange 18 may be secured to the tube 16 immediately at the first end 32. In other applications, however, the flange 18 may be spaced from the first end 32.

The tube 16 may extend into the working chamber 22 by a distance D and may have a diameter d. the flange 18 may have a diameter $d_2$ and a thickness t. The housing 14 may define a cylindrical working chamber having a diameter $d_3$. The distance D may range from approximately 10 mm to approximately 200 mm the diameter $d_1$ of the tube 16 may range from approximately 30 mm to approximately 100 mm. The diameter $d_2$ and thickness t of the flange 18 may range from approximately 35 mm to approximately 90 mm, respectfully. The diameter $d_3$ of the working chamber 22 may range from approximately 50 mm to approximately 250 mm. It will be understood, however, that these exemplary dimensions may vary within the scope of the present teachings.

In one particular application, the distance is approximately 50 mm, the diameter $d_1$ of the tube 16 is approximately 60 mm, the thickness t of the flange 18 is approximately 2.5 mm, and the diameter $d_3$ of the working chamber 22 is approximately 100 mm.

Figure 2:
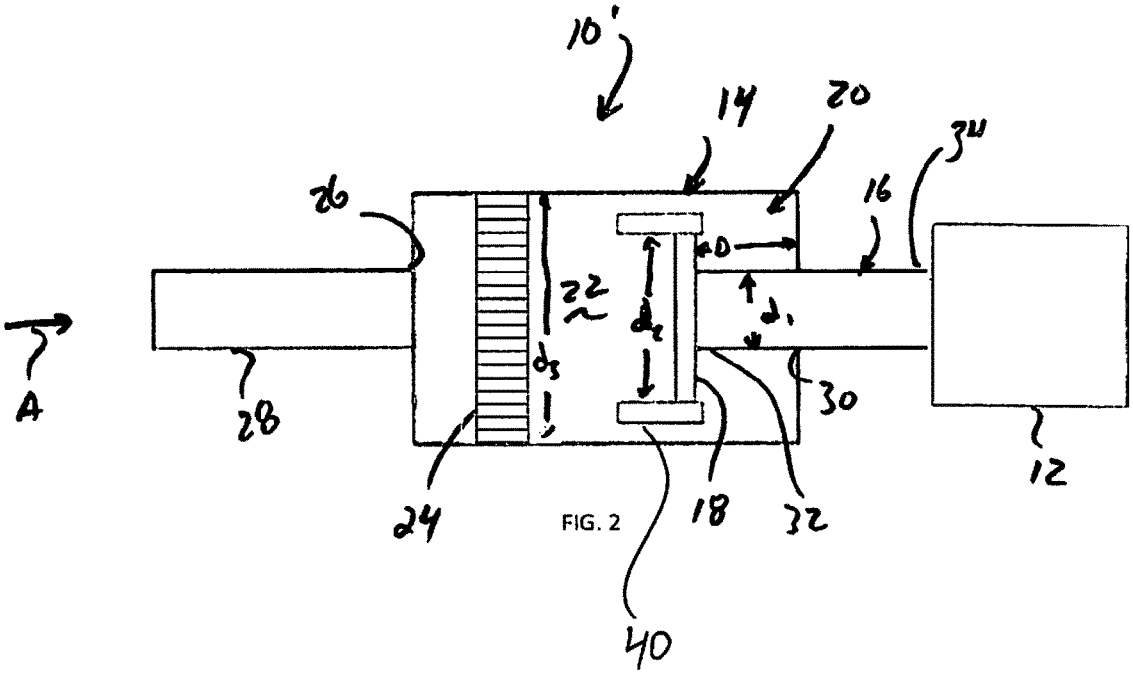
FIG. 2 is another simplified view of an air induction system including a resonator in accordance with the teachings of the present disclosure, the air induction system shown operatively associated with a source of intake air and a vehicle engine.

Turning to the simplified view of FIG. 2, another air induction system in accordance with the present teachings is illustrated and generally identified at reference character 10'. The air induction system 10' differs from the air induction system 10 by further incorporating an axially extending ring 40. Given the similarities between the air induction system 10 and the air induction system 10', similar reference characters will be used to identify similar elements.

The axially extending ring 40 is welded or otherwise securely attached to the flange 18. In the embodiment illustrated, the ring 40 is cylindrical in shape and forwardly extends from the flange 18. With the exemplary dimensions described above for the air induction system 10, the ring 40 may have an axial length L of approximately 30 mm. It will be understood, however, that the axial length L may be longer or shorter within the scope of the present teachings.

Figure 3:
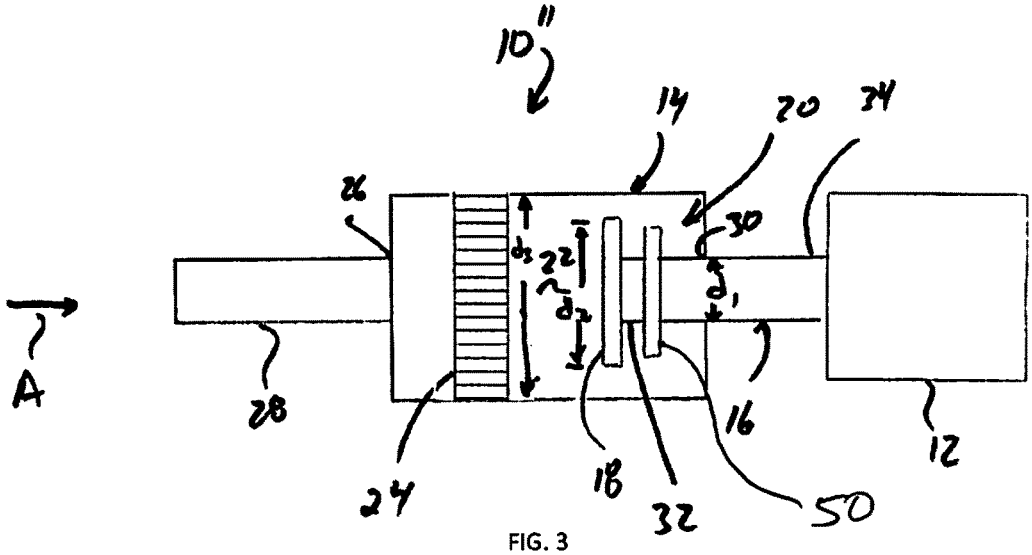
FIG. 3 is another simplified view of an air induction system including a resonator in accordance with the teachings of the present disclosure, the air induction system shown operatively associated with a source of intake air and a vehicle engine.

With reference to the simplified view of FIG. 3, another air induction system in accordance with the present teachings is illustrated a generally identified at reference character 10". The air induction system 10" differs from the air induction system 10 by further incorporating a second flange 50. Given the similarities between the air induction system 10 and the air induction system 10", similar reference characters will again be used to identify similar elements.

As with the first flange 18, the second flange 50 is disposed in the working chamber 22 of the housing 14 and welded or otherwise suitably secured proximate the first end 32 of the tube 16. The second flange 50 may be cylindrical in shape. As illustrated, the second flange may be spaced from the extreme end of the first flange 18 and the second flange 50 may have a diameter smaller than the first flange 18. With the exemplary dimensions described above for the air induction system 10, the second flange 50 may be spaced from the first flange 18 by a distance of about 30 mm and the second flange 50 may have a diameter of about 40 mm.

Figure 4:
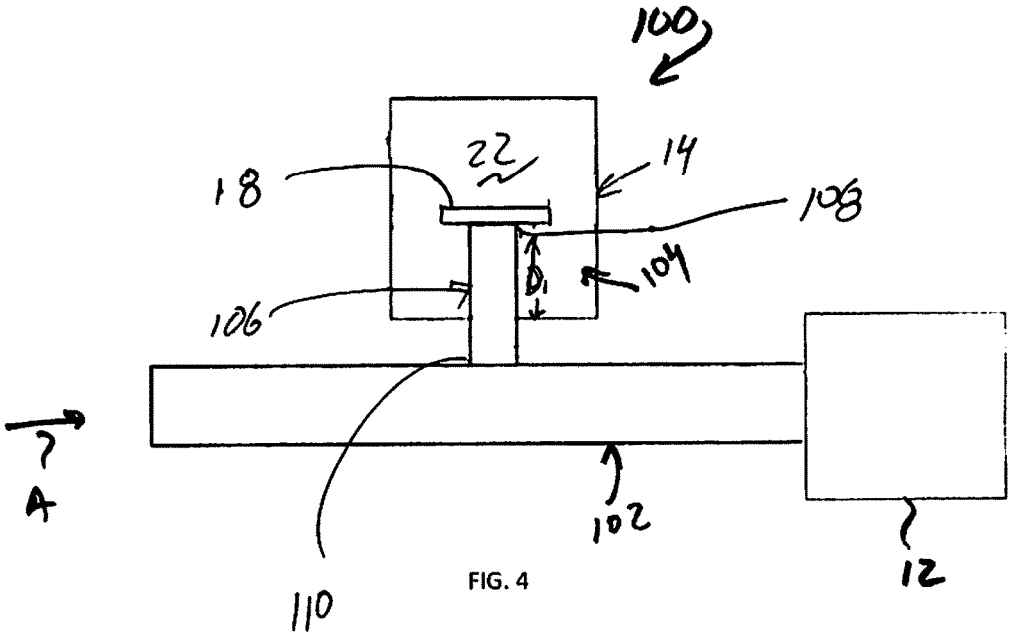
FIG. 4 is another simplified view of an air induction system including a resonator in accordance with the teachings of the present disclosure, the air induction system shown operatively associated with a source of intake air and a vehicle engine.
Figure 5:
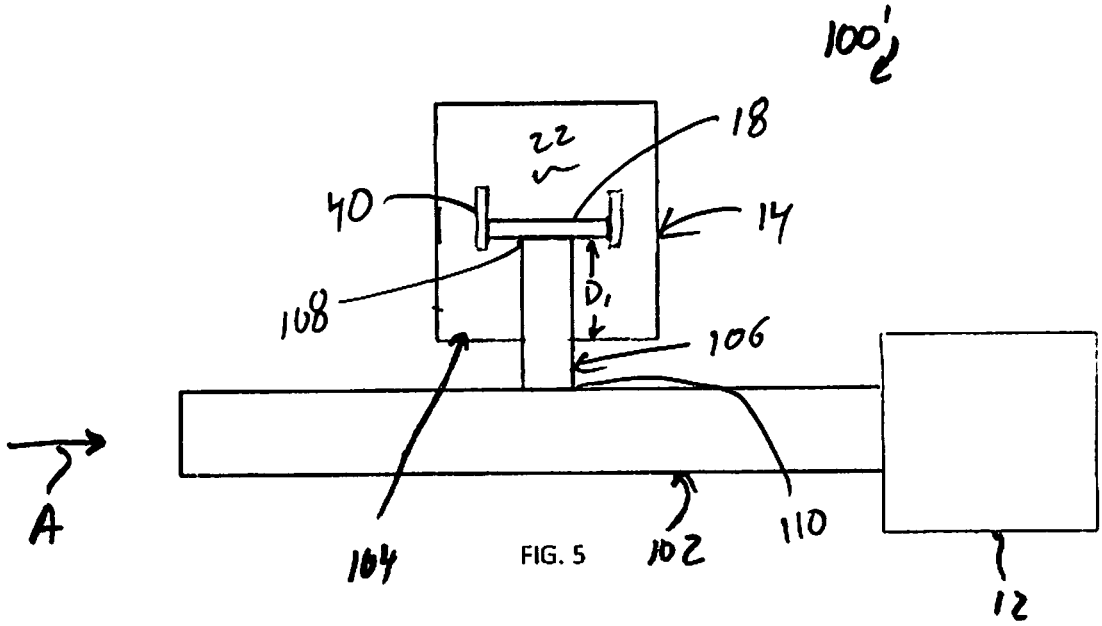
FIG. 5 is another simplified view of an air induction system including a resonator in accordance with the teachings of the present disclosure, the air induction system shown operatively associated with a source of intake air and a vehicle engine.
Figure 6:
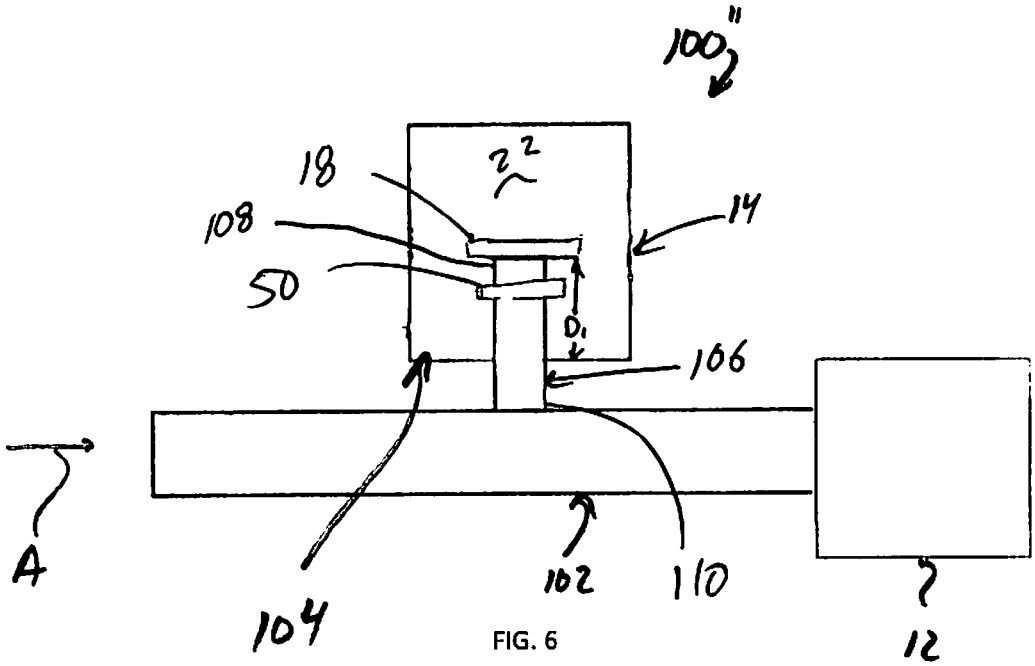
FIG. 6 is another simplified view of an air induction system including a resonator in accordance with the teachings of the present disclosure, the air induction system shown operatively associated with a source of intake air and a vehicle engine.

Turning generally now to FIGS. 4-6, three additional embodiments of air induction systems in accordance with the present teachings are illustrated and generally identified at reference characters 100, 100' and 100". The air induction systems 100, 100' and 100" differ from the air induction systems 10, 10' and 10", respectively, primarily in that the working chamber 22 of the housing 14 is not in line with a conduit 102 that provides for the delivering of intake air A to the engine 18. As such, it will become apparent below that resonators 104 defined by air induction systems 100, 100' and 100" are Helmholz-type resonators 104. Given the similarities between the various embodiments, like reference characters will continue to be used for similar elements.

With particular reference to FIG. 4, the air induction system 100 will be further described. Again, it will be understood that the air induction system 100 is similar in concept to the air induction system 10. In this regard, the air induction system 100 includes a single flange 18 carried by the tube 106. The flange 18 is disposed in the working chamber 22 and is proximate a first end 108 of the tube 106. With the exemplary dimensions described above for the air induction system 10, the tube 106 may extend into the working chamber 22 a distance D, of about 60 mm. A second end 110 of the tube 106 is in fluid communication with the conduit 102. As such, the source of intake air A delivered to the engine 18 flows past the second end 110.

With particular reference to FIG. 5, the air induction system 100' will be further described. The air induction system 100' will be understood to generally combine the concepts of the air induction system 10' and 100. In this regard, the air induction system 100' further incorporates an axially extending ring 40. The exemplary dimensions described above equally apply here.

With particular reference to FIG. 6, the air induction system 100" will be further described. The air induction system 100" will be understood to generally combine the concepts of the air induction system 10" and 100. In this regard, the air induction system 100" further incorporates a second flange 50. The exemplary dimensions described above equally apply here.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An air induction system for attenuating sound produced by an engine, the air induction system comprising:

a housing defining a working chamber for attenuating sound produced by the engine;

a tube having a first end extending into the working chamber and a second end to be in fluid communication with the engine; and a first flange radially extending from the tube and disposed in the working chamber;

wherein the tube, the housing and the first flange cooperate to define a resonator operable to attenuate sound produced by the engine; and a ring axially extending from the first flange.

2. The air induction system of claim 1, wherein the first flange is disposed adjacent the first end.

3. The air induction system of claim 1, wherein the housing is an air filter box housing and further wherein an air filter is disposed in the housing.

4. The air induction system of claim 1, wherein the housing includes an inlet in fluid communication with a source of inlet air and an outlet in fluid communication with the engine.

5. An air induction system for attenuating sound produced by an engine, the air induction system comprising:

a housing defining a working chamber for attenuating sound produced by the engine, the housing including an inlet and an outlet;

a filter disposed in the working chamber between the inlet and outlet of the housing;

a tube having a first end extending into the working chamber and a second end to be in fluid communication with the engine; and a first flange radially extending from the tube and disposed in the working chamber;

wherein the housing, the tube and the first flange cooperate to define a resonator operable to attenuate sound produced by the engine; and a ring axially extending from the first flange.

6. The air induction system of claim 5, wherein the first flange is disposed adjacent the first end.

7. A method of attenuating sound produced by an engine, the method comprising:

providing a housing defining a working chamber for attenuating sound produced by the engine, a tube having a first end extending into the working chamber and a second end to be in fluid communication with the engine, and a first flange radially extending from the tube and disposed in the working chamber; and a ring axially extending from the first flange;

attenuating sound produced by the engine with a resonator cooperatively defined by the tube, the housing and the first flange.

8. The method of claim 7, further comprising:

placing an air filter in the housing; and filtering a source of intake air with the filter.

* * * * *